US010186252B1

(12) United States Patent
Mohammadi

(10) Patent No.: US 10,186,252 B1
(45) Date of Patent: Jan. 22, 2019

(54) TEXT TO SPEECH SYNTHESIS USING DEEP NEURAL NETWORK WITH CONSTANT UNIT LENGTH SPECTROGRAM

(71) Applicant: Seyed Hamidreza Mohammadi, Pasadena, CA (US)

(72) Inventor: Seyed Hamidreza Mohammadi, Pasadena, CA (US)

(73) Assignee: OBEN, INC., Pasadena, CA (US)

( * ) Notice: Subject to any disclaimer, the term of this patent is extended or adjusted under 35 U.S.C. 154(b) by 130 days.

(21) Appl. No.: 15/236,336

(22) Filed: Aug. 12, 2016

Related U.S. Application Data

(60) Provisional application No. 62/204,878, filed on Aug. 13, 2015.

(51) Int. Cl.

| | |
|---|---|
| ***G10L 13/00*** | (2006.01) |
| ***G10L 13/10*** | (2013.01) |
| ***G10L 13/047*** | (2013.01) |
| ***G10L 13/033*** | (2013.01) |
| ***G10L 13/06*** | (2013.01) |
| *G10L 13/07* | (2013.01) |
| *G10L 13/08* | (2013.01) |

(52) U.S. Cl.
CPC ..... *G10L 13/10* (2013.01); *G10L 13/0335* (2013.01); *G10L 13/047* (2013.01); *G10L 13/06* (2013.01); *G10L 13/07* (2013.01); *G10L 13/08* (2013.01); *G10L 2013/105* (2013.01)

(58) Field of Classification Search
CPC combination set(s) only.
See application file for complete search history.

*Primary Examiner* — Vu B Hang
(74) *Attorney, Agent, or Firm* — Andrew S. Naglestad

(57) ABSTRACT

A system and method for converting text to speech is disclosed. The text is decomposed into a sequence of phonemes and a text feature matrix constructed to define the manner in which the phonemes are pronounced and accented. A spectrum generator then queries a neural network to produce normalized spectrograms based on the input of the sequence of phonemes and features. Normalized spectrograms are fixed-length spectrograms with uniform temporal length (i.e., data size), which enables them to be effectively encoded into a neural network representation. A duration generator output a plurality of durations that are associated with phonemes. A speech synthesizer modifies the temporal length (i.e., de-normalizes) of each normalized spectrogram based on the associated duration, and then combines the plurality of modified spectrograms into speech. To de-normalize the spectrograms retrieved from the neural network, the normalized spectrograms are generally expanded in time or compressed in time, thereby producing variable length spectrograms which yield speech that is realistic sounding.

15 Claims, 4 Drawing Sheets

TEXT TO SPEECH SYNTHESIS USING DEEP NEURAL NETWORK WITH CONSTANT UNIT LENGTH SPECTROGRAM

CROSS-REFERENCE TO RELATED APPLICATION(S)

This application claims the benefit of U.S. Provisional Patent Application Ser. No. 62/204,878 filed Aug. 13, 2015, titled "Text to speech synthesis using deep neural network with constant unit length spectrogram modelling," which is hereby incorporated by reference herein for all purposes.

TECHNICAL FIELD

The invention relates to a system and method for converting text to speech. In particular, the invention relates to the conversion of text to speech using fixed-length spectrograms and neural networks.

BACKGROUND

There are a number of text-to-speech synthesis systems in the prior art. The two main categories of text-to-speech synthesis systems are: unit-selection and parametric systems. Unit-selection methods find and join audio segments together to achieve the synthesized speech. These systems typically have high quality output but also have several drawbacks such as: requires large amounts of memory, require high computational power, and have limited flexibility to customize to new speakers or emotions. Parametric methods use statistical models to learn the conversion from text to speech. Some parametric systems employ hidden Markov models (HMM) to perform the conversion. Unfortunately, these HMM's are not capable of encoding standard spectrograms of phonemes because the temporal length of these phonemes is highly variable. Instead, HMM's assume that the sequences of speech segments have a temporal dependence on each other in highly short segments (under 100 milliseconds), which is a sub-optimal model for human speech since speech has transitions that have a much longer context (sometimes ranging to several words). Also the spectrograms are altered in order make the data suitable for the HMM's. Unfortunately, these alterations and modelling assumptions impact the accuracy with which the spectrograms can be encoded in the HMM. There is therefore a need for a system that can encode spectrograms without loss of precision or robustness.

SUMMARY

The invention in some embodiments features a system and method for converting text to speech. The system includes a phoneme generator for first converting the text to a sequence of phonemes, a feature generator defining the character of the phonemes and how they are to be pronounced and accented, a spectrum generator for querying a neural network to retrieve normalized spectrograms based on the input of the sequence of phonemes and the plurality of text features, a duration generator for outputting a plurality of durations that are associated with the phonemes, and a speech synthesizer configured to: modify the temporal length of each normalized spectrogram based on the associated duration, and combine the plurality of the modified spectrograms into speech. The normalized spectrograms are fixed-length spectrograms with uniform temporal length (i.e., data size), which enables them to be effectively encoded into and retrieved from a neural network representation. When converting the text to speech, the normalized spectrograms retrieved from the neural network are generally de-normalized, i.e., expanded in time or compressed in time, thereby producing variable length spectrograms which yield speech that is realistic sounding.

In some embodiments, the pitch contours associated with phonemes are also normalized before retrieval and subsequently de-normalized based on the associated duration. The de-normalized pitch contours are used to convert the de-normalized spectrograms into waveforms that are concatenated into the synthetic speech.

In the embodiment described above, phonemes are the basic unit of speech. In other embodiments, basic speech units are based on diphones, tri-phones, syllables, words, minor phrases, major phrases, other meaningful speech units, or combination thereof for example.

BRIEF DESCRIPTION OF THE DRAWINGS

The present invention is illustrated by way of example and not limitation in the figures of the accompanying drawings, and in which.

DETAILED DESCRIPTION OF THE PREFERRED EMBODIMENT

The present invention is a system and method for producing speech from text. The text is provided directly by a user or is generated by a software application ("app"), for example. The invention then synthesizes speech from the text. The synthesized speech possesses the same linguistic content as the text, and the speaker sounds the same as the speaker that provided the recorded sentences. In the preferred embodiment, the text is converted using three deep neural networks, which are first trained using training speech from this same speaker.

The deep neural networks are each configured to model one of the three main characteristics of human speech necessary to produce speech:

1) speaking rate or duration: The system has to learn how long does the speaker utter a speech unit. The speech unit is typically a phoneme, diphone, triphone, syllable, and word. Shorter or longer speech segments might be considered as units.

2) intonation: Intonation is usually realized as the fundamental frequency (f0) of speech units. The human perception of fundamental frequency is called pitch, which can be represented as logarithm of f0. The fundamental frequency is varied by humans by their movements of vocal cords, generating different intonations.

3) spectrum: The spectral shape of the speech segments are a function of the speaker's vocal tract shape (tongue position, lip shape, etc). For synthesizing speech, we have to estimate the spectral shape from text. The spectral envelope is represented using mel-cepstrum in this embodiment.

Using the three aspects above, the speech is synthesized from text.

Figure 1:
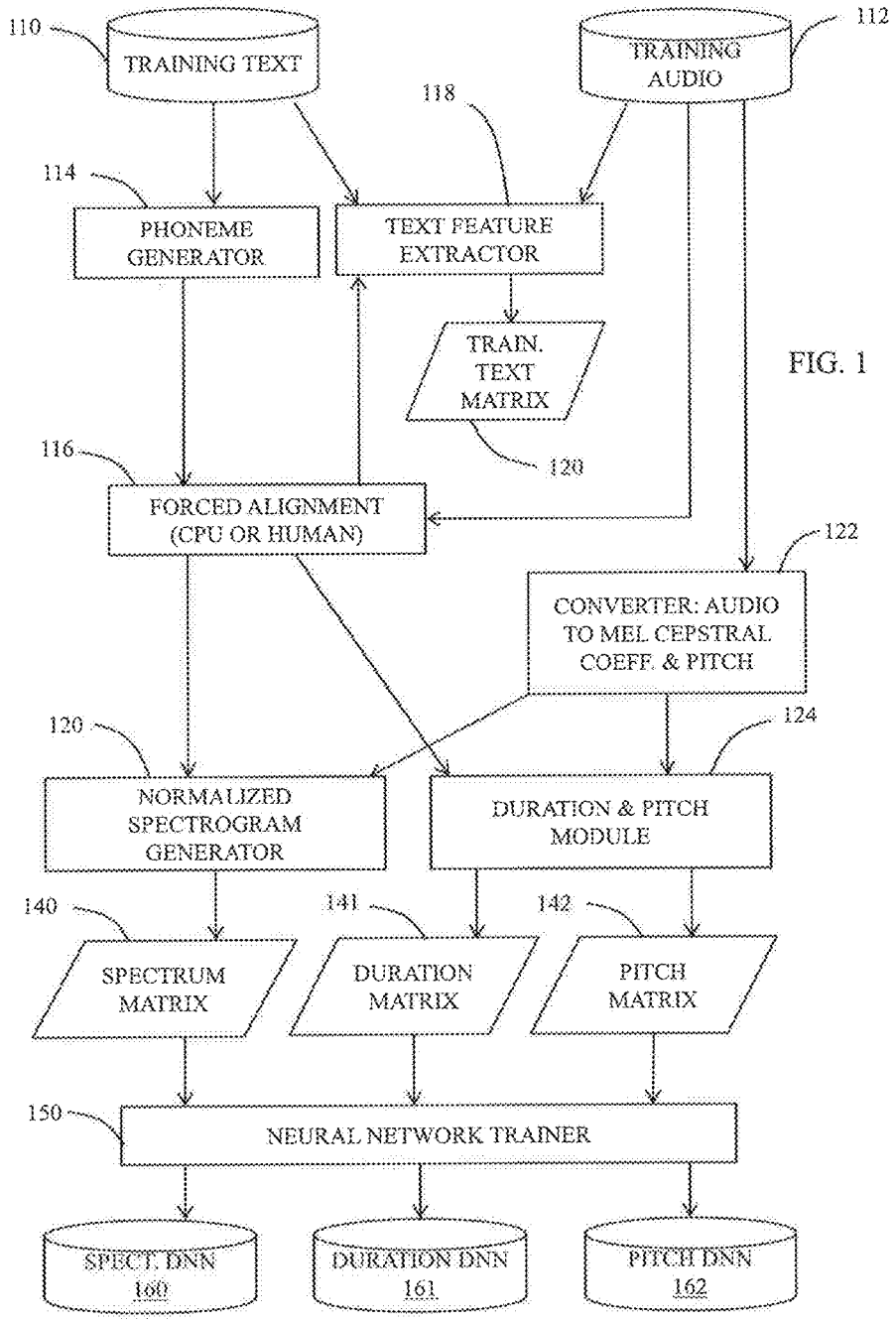
FIG. 1 is a functional block diagram of a system for text to speech conversion using fixed-length phoneme spectrograms, in accordance with a preferred embodiment of the present invention.

Referring to the functional block diagram in FIG. 1, the training of the deep neural network begins with training data including audio recordings 112 of the utterances of the speaker as well as transcripts of the text of the words spoken in the audio recordings. The transcripts take the form of sentences, i.e., a sequence of words referred to herein as "training text." The training text 110 is then passed through a phoneme generator which parses 114 the words of the spoken sentences into a sequence of individual phonemes.

Forced alignment 116 is then used to align, in time, the phonemes of the phoneme sequence with segments of audio for the same phonemes. In particular, forced alignment produces the sequences of phonemes with the start time and end time for each of the phonemes in the audio data. The start time and end time refer to the time in the audio file where the speaker begins uttering the phoneme and finishes uttering the phoneme, respectively. There is a start time and end time for all the phonemes of the phoneme sequence.

Once the start time and end time of a sequence is known, the text feature extraction module 118 extracts various attributes and parameters that characterize the audio data in general and the speaker in particular. In the preferred embodiment, the feature extractor extracts approximately 300 features per phoneme. The sequence of phonemes and features is provided as output in the form of a matrix referred to herein as the "training text matrix" 120, where the size of the two-dimensional matrix is given by the product of the number of phonemes and the number of features per phoneme. In the alternative to forced alignment, the invention is some embodiments utilize human experts to extract and label phonemes and features.

In addition to the training text matrix 110, the system also includes a converter 122 that converts the audio representation of the speaker from an audio file to a representation in terms of Mel Cepstral coefficients and pitch. The Mel Cepstral coefficients and pitch are equivalent to the audio representation in the audio database 112 but are easier to work with.

Based on the output of the forced alignment 116 and the mel cepstal coefficients, a spectrogram generator 120 produces a spectrum matrix 140. The spectrum matrix has a size given by n×(t*f), where n is the number of phonemes, t is the time-resolution of the spectrogram section (preferably 10<t<50), and f is the frequency-resolution of the spectrogram. If the actual given length of the audio segment for the phoneme is different than t, the system may "interpolate" the spectral values to get t samples. To represent a spectrum with a 8 kHz bandwidth using mel-cepstral coefficients, the frequency resolution is set to 100.

In accordance with some embodiments of the invention, the spectrogram generator 120 generates "normalized" spectra 140. Normalized spectra refer to spectra that are represented with a fixed number of data points independent of the duration of the phoneme. In the preferred embodiment, the length of the spectrogram is approximately 50 points in the temporal dimension for all spectrograms. This is different from the prior art where the sampling rate may be fixed which yields a number of spectrogram frames that is linearly proportional to the duration of the phoneme. Using the present invention, however, the entire length of each spectrogram can be properly modeled using the deep neural network.

In addition to the spectrum matrix 140, the duration and pitch module 124 generates a duration matrix 141 and a pitch matrix 142. The duration matrix, which includes the start time and end time for all phoneme, is represented by a matrix having a size n×t. The pitch contour in the pitch matrix is represented by the logarithm of f0, i.e., the pitch or fundamental frequency. The pitch contour is preferably normalized so that all pitch contours have the same fixed-length (analogous to the normalized spectrograms). Interpolation may be used to fill in the times where there is no f0 value available due to unvoiced segments, for example. The pitch matrix 142 has a fixed size given by n×t.

Thereafter, the neural network trainer 150 trains three deep neural networks, one for the spectrum data, one for the duration data, and one for the pitch data. The training is accomplished using a neural network. Let X=[x1, . . . , xN] represent the training text matrix and Y=[y1, . . . , yN] represent the output matrix which is the spectrum matrix, the pitch matrix and the duration matrix for the spectrum DNN, the pitch DNN, and the duration DNN, respectively. The dimension of the matrices are N×M, where N is the number of data samples and M is the dimension of the normalized spectrum representation, the normalized pitch contour, and the duration for the spectrum DNN training, pitch DNN training, and the duration DNN training, respectively.

A DNN model is a sequence of layers of linear transformations of the form Wx+b, where a linear or non-linear transfer function $f(.)$ can be applied to each transformation as $y=f(Wx+b)$. The matrices Wand b are called weight and bias, respectively. The input and output to each layer are represented by x and y, respectively. The goal of DNN training is to estimate all the weights and biases of all the layers, hereon referred to as parameters, of the DNN. We label the parameters and transfer functions of the DNN by subscripts representing their layer number, starting from the input layer. The mapping function for Q-layered DNN is represented as:

$$\hat{Y}=F(X)=f_Q(W_Q \ldots f_2(W_2 f_1(W_1 X+b_2)+b_2)+b_Q)$$

The goal of the DNN training stage is to optimize the F function by estimating the parameters of the model:

$$\hat{Y}=F(X)$$

such that $\hat{Y}$ is the most similar to Y. In the present invention, the Y and $\hat{Y}$ matrices are deemed to be "similar" if the Mean Squared Error (MSE) and the standard deviation of the spectral representations are minimized. Other similarity measures such as cross-entropy, can also be utilized for DNN training purposes. The proposed cost function, also referred to herein as the proposed criterion, is given by:

$$\text{Cost}=\text{MSE}(Y,Y)+\text{STD}(Y,Y)$$

where $$MSE(Y,\hat{Y})=(1/MN)\sum_{n=1}^{N}\sum_{m=1}^{M}(Y_{m,n}-\hat{Y}_{m,n})^2$$

and $$STD(Y, \hat{Y}) = (1/M)\sum_{m=1}^{M}\left(SD_m(Y) - SD_m(\hat{Y})\right)^2$$

Where SD(Y) (and similarly, SD($\hat{Y}$)) is a 1×M matrix in which each column represents the standard deviation of each dimension, computed for each dimension m as $$SD_m(Y) = \sqrt{\sum_{n=1}^{N}\left(Y_{m,n} - (1/N)\sum_{j=1}^{N} Y_{j,m}\right)^2}$$

The vectors X and Y can be used to train the deep neural network using a batch training process that evaluates all data at once in each iteration before updating the weights and biases using a gradient descent algorithm. In an alternate embodiment, training is performed in mini batches sometimes referred to as stochastic gradient descent where the batch of all samples is split into smaller batches, e.g., 100 samples each, and the weights and biases updated after each mini-batch iteration.

Figures 2A, 2B:
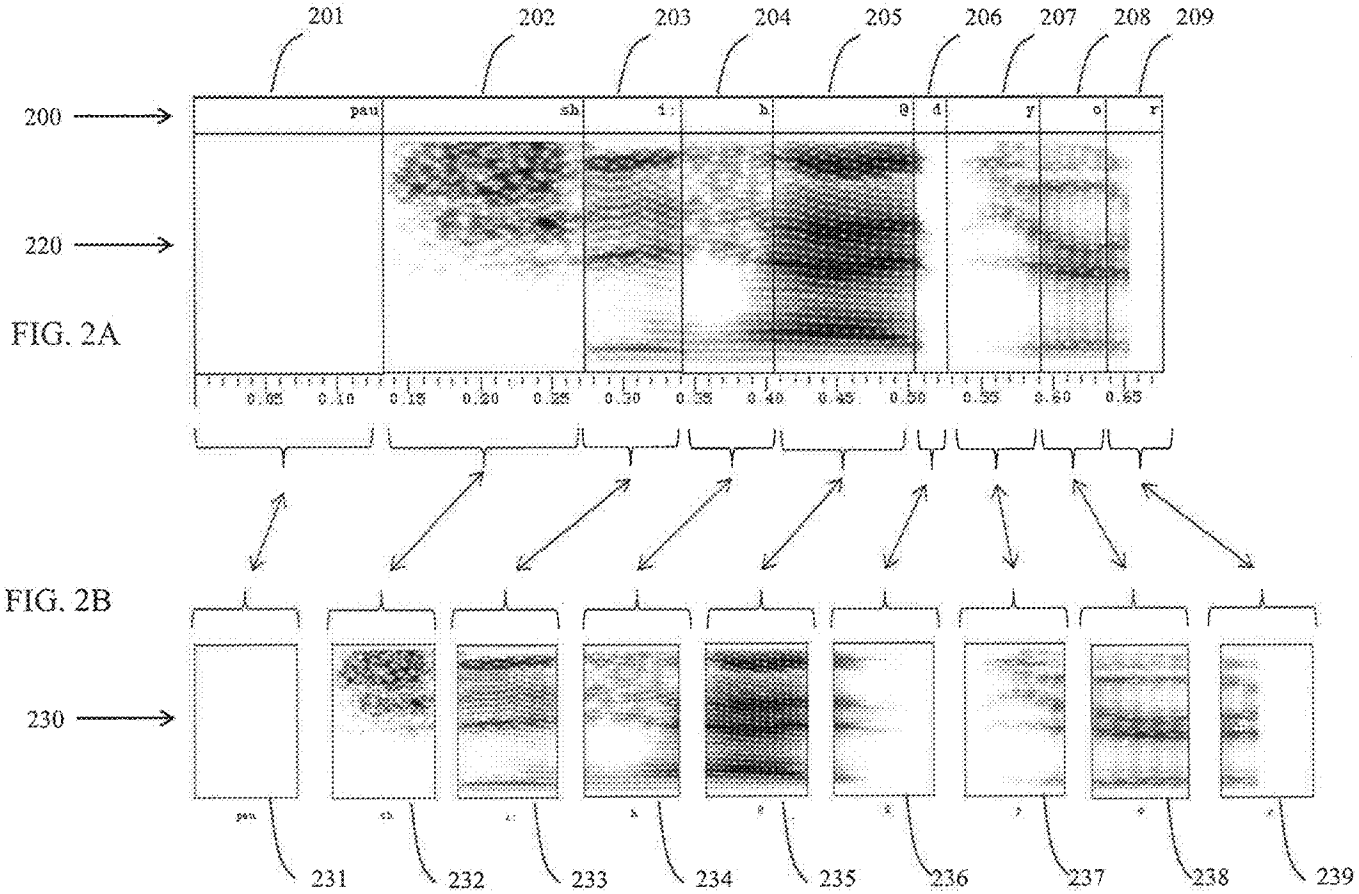
FIG. 2A is a spectrogram with variable length phoneme, in accordance with the prior art.
FIG. 2B is a spectrogram with fixed-length phoneme, in accordance with the preferred embodiment of the present invention.

Illustrated in FIG. 2A is a prior art spectrogram representation of a sequence of phonemes 200. The sequence of phonemes includes a plurality of individual phonemes 201-290 that collectively form words and/or sentences. The sentence here reads "SHE HAD YOUR . . . ". FIG. 2A also includes the spectrogram 220 for each of the phonemes 201-209 of the sentence. The spectrogram and corresponding transitions are indicated by a box directly below the associated phoneme. As can be seen, the duration of the set of phonemes is quite variable and may differ by an order of magnitude, for example. This figure illustrates the typical spectrogram representation used in the prior art to encode a hidden Markov model (HMM). This variable-length representation, however, is difficult to encode in a HMM and results in various approximations that reduce the accuracy of the spectrogram model.

In contrast to the prior art, FIG. 2B illustrates spectrogram encoding in accordance with the preferred embodiment of the present invention. In this case, the spectrograms 231-239 are illustrated as equal-size matrices. The duration, i.e., the temporal length, of all the spectrograms 230 is uniform for the entire sequence of phonemes. The same spectral content is present as the prior art spectrograms 220, but the fixed length of these "normalized" spectrograms is better suited for encoding in the deep neural network employed in the present embodiment.

In addition to normalized spectrograms, the preferred embodiment also normalizes the temporal duration of the corresponding pitch contours for purposes of training the deep neural networks 162. After the DNNs are trained and subsequently used to retrieve spectral information, the spectrograms are "de-normalized" and used to produce a sequence of audio data that becomes the synthesized speech.

Figure 3:
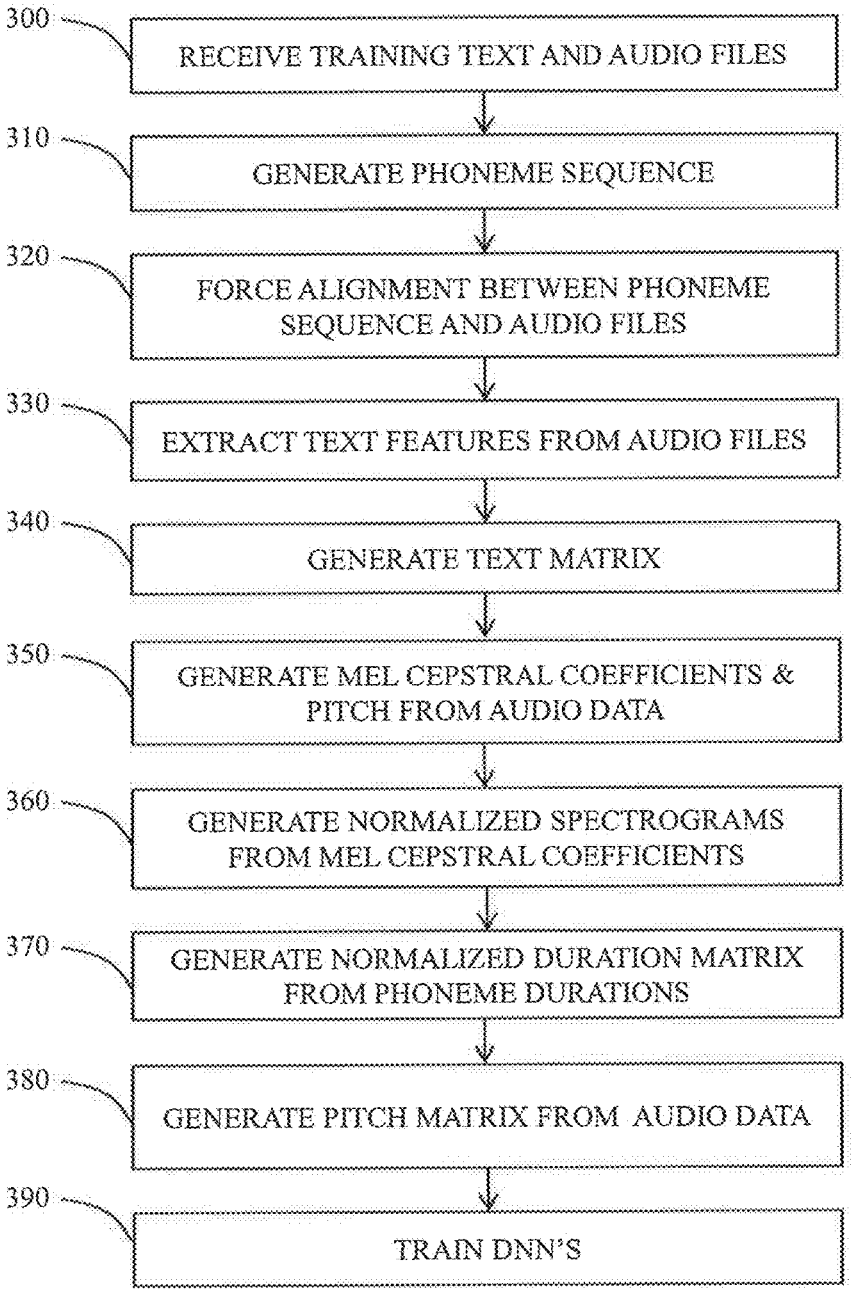
FIG. 3 is a method of training neural networks for text to speech conversion using fixed-length phoneme spectrograms, in accordance with the preferred embodiment of the present invention.

Illustrated in FIG. 3 is a flowchart of the method of generating the deep neural networks used to produce speech from text. The training text and audio files are received 300 as input from the speaker whose voice will be used to generate the speech from the text. The training text, a sequence of words, is translated 310 into a sequence of phonemes. The phonemes are then aligned 320 in time with the audio of the person speaking the words, using force alignment techniques for example, yielding a sequence of words and their start and stop times (or durations) in the audio data. Next, various features characterizing the audio, referred to herein as "text features," are extract 330 and used to populate 340 a matrix in a way that preserves the temporal relationship between the phonemes and the text features. The audio recording of the speaker is also converted 350 into a representation based on mel cepstral coefficients for simplicity, and the mel cepstral coefficients and sequence of start and stop times of phonemes used to generate 360 normalized spectrograms for individual phonemes. In accordance the preferred embodiment, all the normalized spectrograms generated are represented by a fixed number of sample points in the time dimension, thus make the width of the spectrogram matrices uniform independent of the time over which the phoneme was uttered. In addition to a spectrogram matrix generated from the mel cepstral coefficients, a duration matrix is generated 370 from the start and stops times of the phonemes and a pitch matrix is generated 380 from the normalized pitch contours extracted from audio data.

Thereafter, a deep neural network is trained 390 to encode the information represented in each of the spectrum matrix, the duration matrix, and the pitch matrix.

Figure 4:
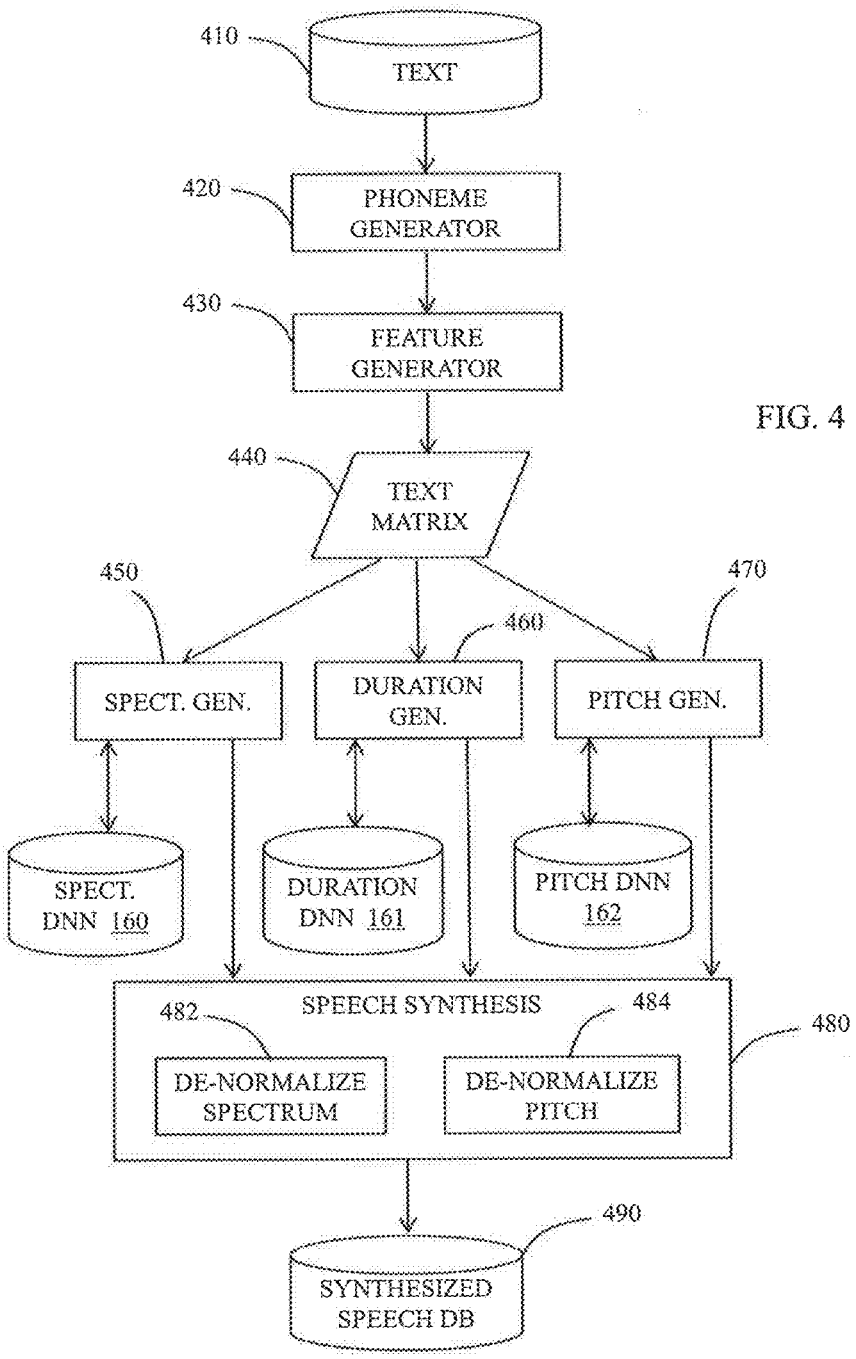
FIG. 4 is a functional block diagram of a system for converting text to speech with fixed-length phoneme spectrograms, in accordance with the preferred embodiment of the present invention.

Text features include, but are not limited to:

Syllable level:
Stress (Is the Syllable stressed?)
Accent (Is the Syllable accented?)
Length (The number of phonemes in the Syllable)
Position of Syllable in Phrase
Distance from the nearest stressed syllable
Distance from accented syllable
Vowel of current Syllable,
Tone information (suitable for Tonal languages)
The above information for several previous and next syllables
Word level:
Part-of-Speech (POS) information
The number of syllables in the word
Position in the phrase
Word prominence information
The above information for several previous and next words
Phrase level:
The number of syllables in the phrase
The number of words in the phrase
Position in major phrase
The above information for several previous and next phrases
Utterance:
The number of syllables in the utterance
The number of words in the utterance
The number of phrases in the utterance Illustrated in FIG. 4 is a functional block diagram of the speech synthesis system of the preferred embodiment of the present invention. The speech to be converted is first received 410 from a user, a computer, or a software application like a GPS navigation system, for example. The text is generally in the form of sentences or a sequence of words. The words are then translated into a sequence of phonemes by the phoneme generator 420. The feature generate 430 then produces "text features" that define the quality and character of the speech to be produced. Using the phonemes and the text features associated with the phonemes, the feature generator 430 produces a "text matrix" comprising the phonemes and text features.

The text matrix is then provided as input to the spectrum generator 450, duration generator 460, and pitch generator 470. In turn, the spectrum generator 450 queries the spectrum DNN 160 with each of the individual phonemes of the text matrix and the text features associated with the individual phoneme. The spectrum DNN 160 then outputs the spectrogram for that phoneme and features. The spectrogram represents the voice of the speaker with the attributes defined by the text features. As described above, the temporal length of the spectrogram is fixed so all the phonemes are unit length. A spectrum of unit length is referred to herein as a normalized spectrum.

In parallel to the spectrum generator, the duration generator 460 queries the duration DNN 161 to produce a number representing the time, i.e., the duration, the corresponding phoneme should take to utter based upon the phoneme and the text features. Also in parallel, the pitch generator 470 queries the pitch DNN 162 to produce an array representing the normalized pitch contours over the same unit length used to encode the spectrogram. This pitch contour represents the fundamental frequency sequence with which the phoneme should be spoken based upon the particular phoneme and the text features.

For each phoneme, the speech synthesis module 480 alters the normalized spectrum based on the duration provided by the duration generator. In particular, the de-normalize spectrum module 482 either stretches or compresses the normalized spectrum so that it is the length specified by the duration. In some cases, the normalized spectrogram is down-sampled to remove frames to reduce the length of the spectrum. In other cases, interpolation may be used to add frames to increase the duration beyond that of the normalized spectrogram.

Similar to that above, the de-normalize pitch module 484 either stretches or compresses the normalized pitch contour so that it is the length specified by the duration. In some cases, the pitch array is down-sampled to remove frames to reduce the length. In other cases, interpolation may be used to add frames to increase the duration beyond that of the normalized pitch contour.

After the de-normalized spectrum and de-normalized pitch array are generated, the speech synthesis module 480 generates a segment of speech reflecting this newly generated spectrogram and pitch. The process is repeated for each phoneme of the phoneme sequence and the resulting segments of speech concatenated and filtered as necessary to yield the newly synthesized speech outputted to the database 490.

One or more embodiments of the present invention may be implemented with one or more computer readable media, wherein each medium may be configured to include thereon data or computer executable instructions for manipulating data. The computer executable instructions include data structures, objects, programs, routines, or other program modules that may be accessed by a processing system, such as one associated with a general-purpose computer or processor capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system. Examples of mass storage devices incorporating computer readable media include hard disk drives, magnetic disk drives, tape drives, optical disk drives, and solid state memory chips, for example. The term processor as used herein refers to a number of processing devices including personal computing devices, servers, general purpose computers, special purpose computers, application-specific integrated circuit (ASIC), and digital/analog circuits with discrete components, for example.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

I claim:

1. A system for converting text to speech, the system comprising: original an integrated circuit comprising a phoneme generator configured to convert text to a sequence comprising a plurality of phonemes;

an integrated circuit comprising a feature generator configured to create a plurality of text features to characterize the sequence of phonemes;

an integrated circuit comprising a spectrum generator configured to output a plurality of normalized spetrograms based on the sequence of phonemes and the plurality of text features;

an integrated circuit comprising a duration generator configured to output a plurality of durations; each duration associated with one phoneme of the sequence of phonemes; and an integrated circuit comprising a speech synthesizer configured to:

a) modify a temporal length of each normalized spectrogram based on the associated duration; and b) combine the plurality of modified spectrograms into speech.

2. The system of claim 1, wherein the normalized spectrograms are fixed-length spectrograms with uniform length.

3. The system of claim 2, wherein modify a temporal length of each normalized spectrogram comprises:

increasing a temporal length of one or more normalized spectrograms; or reducing a temporal length of one or more normalized spectrograms.

4. The system of claim 3, further comprising:

a first neural network configured to encode associations between the plurality of text features and the plurality of normalized spectrograms.

5. The system of claim 4, further comprising:

a second neural network configured to encode associations between the plurality of text features and the plurality of durations.

6. The system of claim 1, further comprising a pitch generator configured to output a plurality of normalized pitch contours based on the sequence of phonemes and the plurality of text features; each normalized pitch contour is associated with one of the plurality of normalized spectrograms.

7. The system of claim 6, wherein the speech synthesizer is further configured to:

a) modify a pitch of each normalized spectrogram based on the associated normalized pitch contour.

8. The system of claim 7, further comprising-a third neural network configured to encode associations between the plurality of text features and the plurality of normalized pitch contours.

9. A system for converting text to speech, the system comprising:

an integrated circuit comprising a speech unit generator configured to convert text to a sequence comprising a plurality of speech units;

an integrated circuit comprising a feature generator configured to create a plurality of text features to characterize the sequence of speech units;

an integrated circuit comprising a spectrum generator configured to output a plurality of normalized spectrograms based on the sequence of speech unites and the plurality of text features;

an integrated circuit comprising a duration generator configured to output a plurality of durations; each duration associated with one speech unit of the sequence of speech units; and an integrated circuit comprising a speech synthesizer configured to:

a) modify a temporal length of each normalized spectrogram based on the associated duration; and b) combine the plurality of modified spectrograms into speech.

10. The system in claim 9, wherein the speech unit is selected from the group consisting of: phonemes, diphones, tri-phones, syllables, words, minor phrases, and major phrases.

11. The system in claim 9, wherein the spectrum generator is configured to generate the normalized spectrograms based in part on spectral representations of audio data from a speaker.

12. The system in claim 9, wherein the integrated circuit comprises an application-specific integrated circuit (ASIC).

13. The system in claim 1, wherein the integrated circuit comprises an application-specific integrated circuit (ASIC).

14. A non-transitory computer-readable medium encoding a computer program defining a system for converting text to speech, the system comprising:

a phoneme generator configured to convert text to a sequence comprising a plurality of phonemes;

a feature generator configured to create a plurality of text features to characterize the sequence of phonemes;

a spectrum generator configured to output a plurality of normalized spectrograms based on the sequence of phonemes and the plurality of text features;

a duration generator configured to output a plurality of durations; each duration associated with one phoneme of the sequence of phonemes; and a speech synthesizer configured to:

a) modify a temporal length of each normalized spectrogram based on the associated duration; and b) combine the plurality of modified spectrograms into speech.

15. A non-transitory computer-readable medium encoding a computer program defining a method for converting text to speech, the method comprising:

converting text to a sequence comprising a plurality of phonemes:

generating a plurality of text features to characterize the sequence of phonemes;

generating a plurality of normalized spectrograms based on the sequence of phonemes and the plurality of text features;

generating a plurality of durations; each duration associated with one phoneme of the sequence of phonemes; and modifying a temporal length of each normalized spectrogram based on the associated duration; and combining the plurality of modified spectrograms into speech.

* * * * *